United States Patent [19]

Lalick

[11] 3,944,224

[45] Mar. 16, 1976

[54] POCKET ASSEMBLY FOR A POOL TABLE

[76] Inventor: Michael J. Lalick, 3700 W. 97th St., Evergreen Park, Ill. 60642

[22] Filed: Nov. 11, 1974

[21] Appl. No.: 522,707

[52] U.S. Cl. ..... 273/12
[51] Int. Cl.[2] ..... A63D 15/00
[58] Field of Search ..... 273/12, 14, 8, 9, 3, 6

[56] References Cited

UNITED STATES PATENTS

| | | | |
|---|---|---|---|
| 281,518 | 7/1883 | Kierenapp | 273/12 |
| 1,154,865 | 9/1915 | Jaeger | 273/12 |
| 1,539,192 | 5/1925 | Jaeger | 273/12 |
| 1,608,749 | 11/1926 | Jaeger | 273/12 |
| 2,094,130 | 9/1937 | Matteson | 273/12 |

*Primary Examiner*—Richard C. Pinkham
*Assistant Examiner*—William R. Browne
*Attorney, Agent, or Firm*—Hill, Gross, Simpson, Van Santen, Steadman, Chiara & Simpson

[57] ABSTRACT

A pocket assembly for a pool table comprising a pocket and a pocket support structure which is mountable in a gap between the ends of rails of a pool table and supports the pocket beneath the gap and adjacent a cut-out portion of the bed of the table. The pocket is a one-piece molded container having an opened end which has a stepped configuration to provide an upper portion having a reinforcing band and a lower portion having a plurality of upstanding tabs. The pocket support structure comprises a pocket iron with an integrally molded cover which has an upper surface, curved outer surface, curved and slanting inner surface, a bottom surface, a flange which has substantially the same curvature as the outer curved surface and extends downwardly from the bottom surface, and a shield which has a center portion and a pair of end portions. The center portion extends downwardly along a line equally spaced from the flange to provide a curved recess therebetween which receives the reinforcing band as the pocket is attached to the structure.

8 Claims, 7 Drawing Figures

Fig. 3
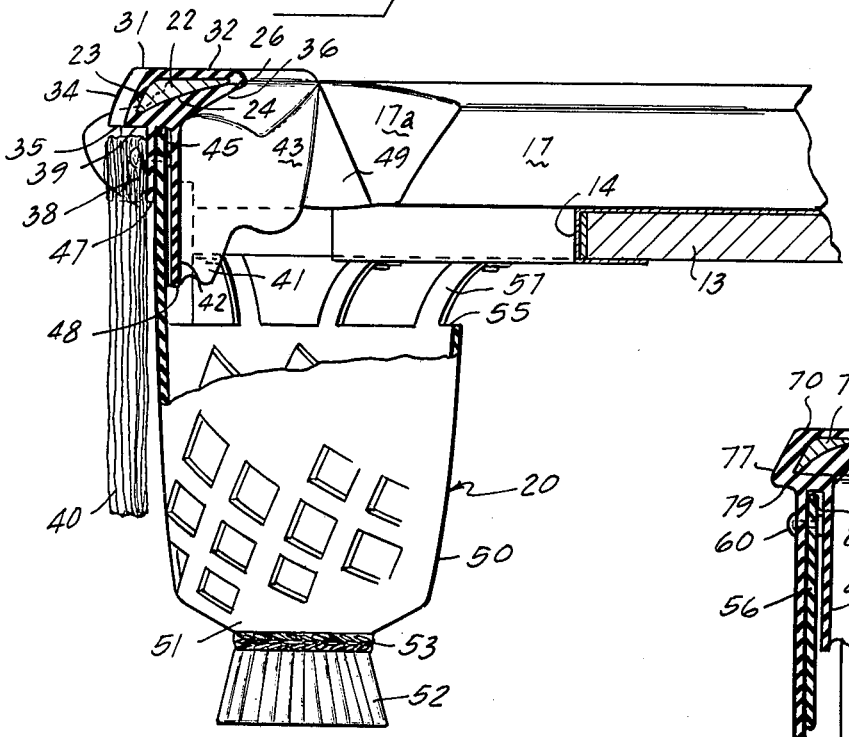
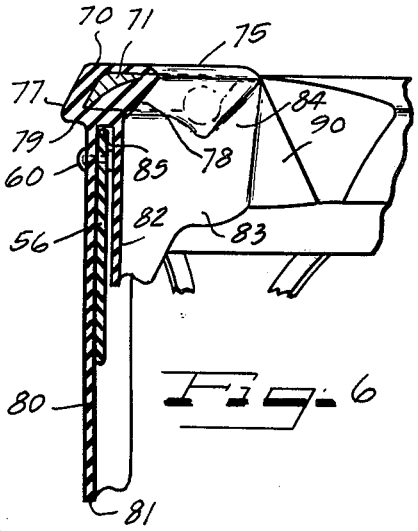
Fig. 6
Fig. 4
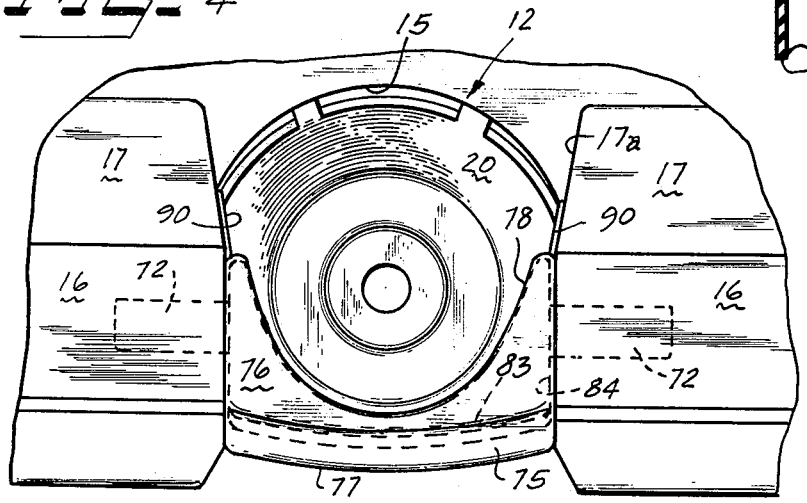
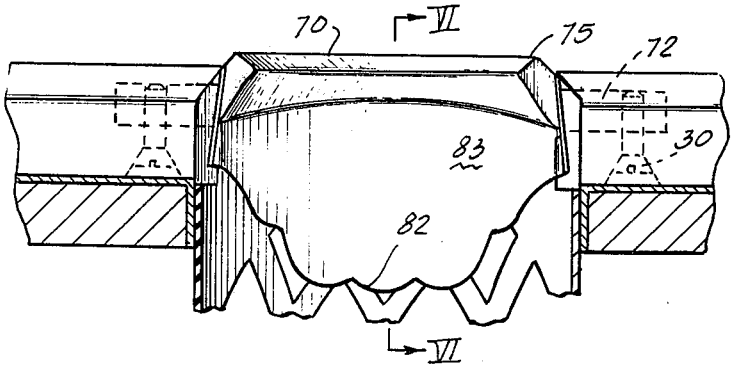
Fig. 5

POCKET ASSEMBLY FOR A POOL TABLE

BACKGROUND OF THE INVENTION

The present invention is directed to a pool table pocket assembly, the pocket support structure and to a one-piece pocket.

In pool tables, the bed of the pool table is provided with a cut-out portion for each of the corner pockets and for the two side pockets. The rails of the pool table are cut to provide gaps adjacent each of the cut-out portions. A pocket assembly is then mounted in the gaps with the pocket positioned to receive a pool ball which falls through the cut-out portion and into the pocket.

The pocket assembly requires a support member which is usually made of a durable metal and is provided with a pair of mounting projections which are received in the ends of the rails forming the gap. The pocket iron is then covered with a cover of suitable material and the pocket is attached to the cover so that it is supported in the correct position to receive a ball knocked into the pocket. One type of cover is a leather cover of high quality which is stitched onto the iron and then has a pocket such as a leather pocket and a pocket shield attached to the cover. Due to the fact that leather of high quality is difficult to obtain, covers which are made of synthetic material have been proposed and a plastic pocket has also been proposed.

A synthetic cover has been proposed which is molded in one piece and is provided with an opening at each end for the mounting projections and curved flanges which extend between the openings and provides a slot for inserting the pocket iron. The pocket iron is then inserted into the molded cover and the pocket is stitched to the outer flange with the inner flange either acting as a shield or having a shield attached thereto. One difficulty with the above described synthetic pocket is that the curvature of the two flanges is at a smaller radius than the curvature of the outer surface so that the shield is not in a proper location. The second difficulty is that when the assembly is mounted in the gap, the curvature of the flanges exposes the ends of the rails unless additional material is stitched or attached to the covering to cover the exposed ends.

In all of the above type of pocket assemblies, the attachment of the pocket to the covering whether it is a sewn leather cover or a synthetic cover and whether the pocket is a leather pocket or a synthetic pocket requires numerous manipulative steps which are time consuming and add to the cost of the pocket assembly.

SUMMARY OF THE INVENTION

The present invention is directed to a pocket support structure, a one-piece pocket, and a pocket assembly which is assembled therefrom and is assembled with a minimum number of manipulative steps. The assembly when mounted in a gap of a pool table covers exposed ends of the rails and provides a shield having the desired contour.

To accomplish these tasks, the pocket support structure includes a pocket iron arm having a body portion with mounting projections extending from each end, and a synthetic cover integrally molded on the body portion. The cover has an upper surface extending between a pair of ends, an outer curved surface extending downward from the upper surface, an inner curved surface slanting downward and outwardly from the upper surface, and a bottom surface interconnecting the inner and outer surfaces. The cover includes an integral outer curved flange which extends downward from the bottom surface adjacent the outer surface and has substantially the same curved configuration as the outer surface. The cover has an integral, downwardly extending shield which has a center portion and a pair of end portions. The center portion has a curvature approximately the same as the curvature of the flange and extends from a line adjacent to the merger between the inner surface and the bottom surface and equally spaced from the flange to provide a curved recess between the center portion and flange for receiving portions of a pocket which is to be attached thereto. Each of the end portions extends substantially parallel to the ends of the cover. The pocket comprises a one-piece molded container having an opened upper end which has a stepped configuration providing an upper end portion and a lower end portion. The lower end portion has spaced upstanding tabs for attaching a portion of the pocket to a bed of a pool table and the upper end portion has a reinforcing band to provide rigidity for the pocket and to provide for attaching the pocket in the recess of the pocket support structure.

BRIEF DESCRIPTION OF THE DRAWINGS

FIG. 3 is a cross section taken on line III—III of FIG. 2;

FIG. 4 is a plan view of an embodiment of the pocket assembly of the present invention used as a side pocket;

FIG. 5 is a cross-sectional view taken from lines V—V of FIG. 4;

FIG. 6 is a cross-sectional view taken on lines VI—VI of FIG. 5; and

DESCRIPTION OF THE PREFERRED EMBODIMENT

Figure 1:
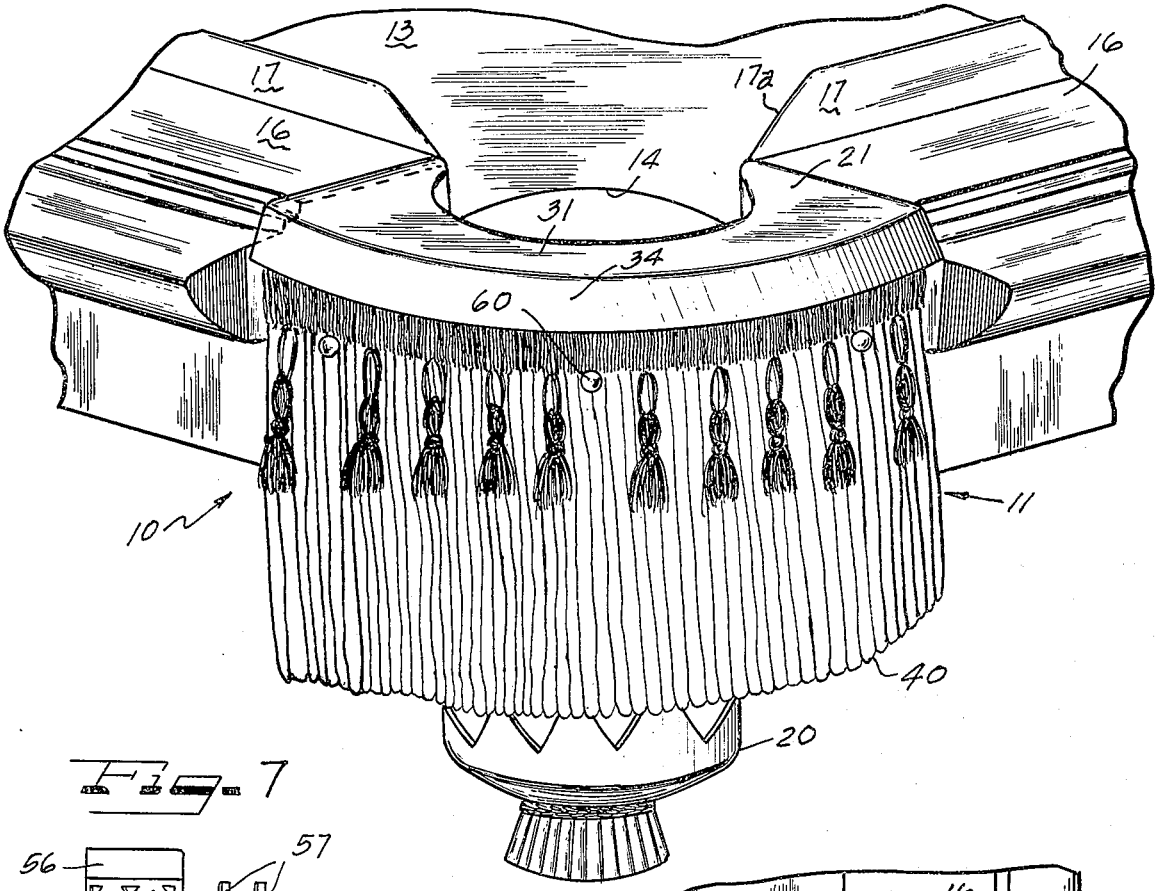
FIG. 1 is a fragmentary perspective view of a pocket assembly according to the present invention installed as a corner pocket in a pool table.

The principles of the present invention are particularly useful when incorporated in a cover pocket assembly generally indicated at 10 in FIG. 1 for a pool table 11 or when incorporated as a side pocket assembly generally indicated at 12 in FIG. 4.

The table 11 has a bed 13 which is formed of slate supported on a frame and covered with cloth in a quality table and formed of wood or a composition board and covered with cloth in the inexpensive tables. As illustrated, the bed is provided with a cut-out 14 (FIG. 2) at each corner and a cut-out 15 (FIG. 4) for the two side pockets. The table 12 also includes a plurality of rails 16,16 which are provided with a resilient bumper 17. The rails are mounted either on the bed 13 or on a support frame for the slate bed with free ends such as 18,18 forming a gap 19 which receives the pocket assembly such as 10 or the side pocket assembly 12.

Figure 2:
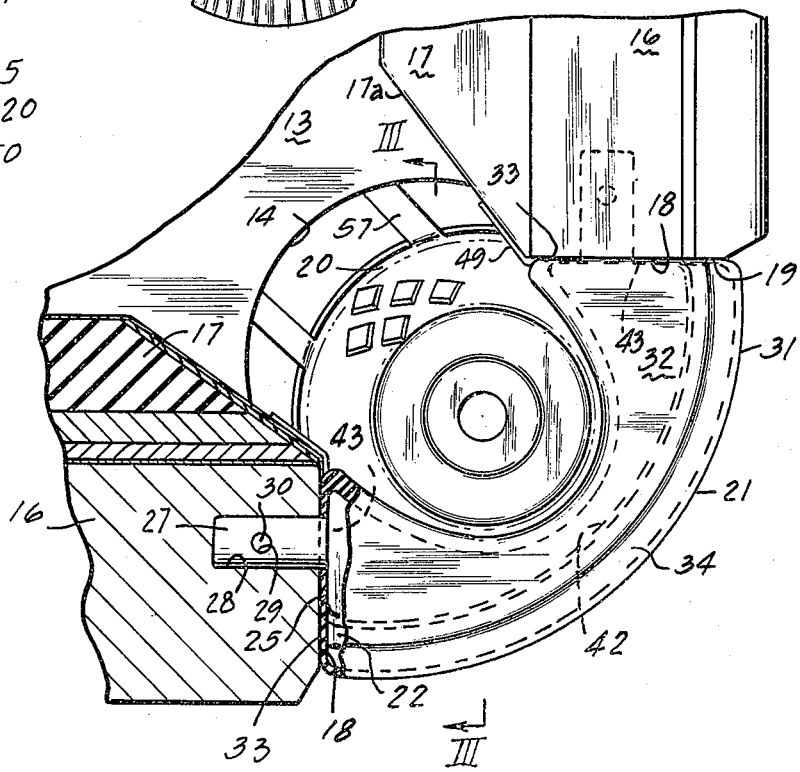
FIG. 2 is a plan view with portions broken away for purposes of illustration of the pocket assembly of FIG. 1.

The pocket assembly 10 includes a pocket 20 and a support structure 21. The support structure as best illustrated in FIGS. 2 and 3 has a pocket iron 22 which has a body portion with an outer curved surface 23 and inner curved surface 24, and a pair of substantially flat end surfaces 25,25. As illustrated, the outer curved surface 23 extends through a 90° arc so that the ends 25,25 are substantially in perpendicular planes. The inner curved surface 24 slopes downwardly and outwardly from a lip 26 (FIG. 3) and has a U-shaped configuration. A mounting projection 27 extends from each of the ends 25 which projection is received in a bore 28 in the end of the rail 16. To maintain the iron in the desired position, each of the projections 27 is provided with a bore 29 which receives a fastening element such as a machine screw 30 (FIG. 5).

The iron 22 is provided with an integral molded cover 31 which has an upper surface 32 extending between a pair of ends 33, 33. The cover 31 has an outer curved surface 34 which extends downward from the upper surface 32 and as illustrated in FIG. 3, extends radially outward and merges with a bottom surface 35. The cover 31 also includes an inner curved surface 36, which extends downwardly and radially outwardly to merge with the bottom surface and provides a downward deflecting surface to deflect any ball striking the inner surface in a downward direction into the pocket 20.

As best illustrated in FIG. 3, an integral curved flange 38 extends downward from the bottom 35 and has a curvature substantially equal to the curvature of the outer surface 34. The flange is adjacent to the outer surface 34 and set inward to provide an offset 39 which enables attachment of a decorative fringe 40 thereto with the fringe being substantially in line with the outer surface 34.

Also extending downward from the covering is an integral shield 41 which has a center portion 42 and a pair of end portions 43. The end portions 43 are substantially parallel to the end 33 of the cover. The center portion 42 of the shield 41 extends from a curved line which is adjacent a merger between the bottom surface 35 and the inner curved surface 36 and which line is equally spaced from the flange 38 to provide a recess 45 (FIG. 3) between the flange 38 and the center portion for receiving a portion of the pocket. As illustrated, the shield extends downward past a lower edge 47 of the flange 38 and terminates in a ruffled edge 48 which has asthetic qualities. Each of the end portions 43 has a tab 49 projecting outward therefrom which tab may be shaped or cut to provide a merging joint with an end 17*a* of the bumper 17.

Figure 7:
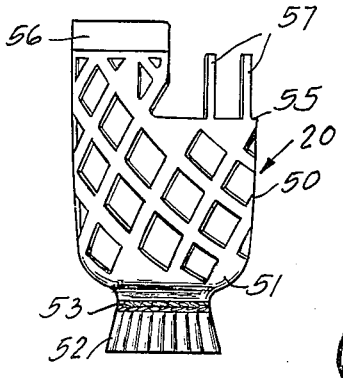
FIG. 7 is a perspective view of the pocket of the present invention.

While the pocket 20 may be of any construction such as a sewn leather pocket having tabs which are received in the recess 45, preferably the pocket 20 (FIG. 7) is a one-piece molded synthetic pocket. As molded, the pocket has a container shape with a body portion 50 which is provided with triangular and diamond-shaped openings and extends to a closed end 51. The closed end is provided with a downwardly extending flange 52 that has an integrally molded knot 53 for decorative purposes which flange 52 and knot 53 simulate the tied end of a leather pocket. The body portion 50 has an opened upper end having a step configuration with a lower portion 55 and an upper portion formed by an integral reinforcing band 56 with each portion being approximately half of a circle. The lower portion 55 has a plurality of spaced upstanding tabs 57 which may be bent and attached to a bottom surface of the bed 13 adjacent the opening 14. The reinforcing band 56, which extends around approximately one-half of the periphery of the opening, provides rigidity for the pocket 20 and facilitates attachment of the pocket to the flange 38.

The pocket may be attached by any desirable means such as sewing to the flange 38 without attaching or sewing to the shield 41. Preferably, the pocket and the fringe 40 are attached simultaneously by a plurality of decorative fasteners, such as rivets 60 which coact with the fringe 40 to provide a decorative appearance to the outer surface of the pocket and the shield 41 will be free of any attachment means. Due to the configuration of the flange 38 and the center portion 42 of the shield, the ends 18 of the rails 16 are substantially covered as illustrated in FIG. 1 to give a highly pleasing appearance to the installed pocket assembly 10. It is also noted, that due to the center portion 42 of the shield 41 having the same curvature as the flange 38 and the outer surface 34 the corners of the shield adjacent the side portion 43 are disposed outward of the projection such as 27. While such a structure could be obtained by the leather coverings which were sewn with the shields, previous attempts at molded synthetic coverings were unable to provide the configuration of the shield as obtained with the integrally molded cover 31.

As mentioned, each of the pockets 20 in the upper portion have the reinforcing band 56 which facilitates a quick assembly such as by the rivets 60. Due to the continuous nature of the band 56, problems with positioning a portion such as a tab of the prior art pocket in the recess 45 for alignment with the rivet 60 are eliminated and thus the time required to align the pocket in the recess is greatly reduced.

The pocket assembly 12 of FIGS. 4, 5 and 6 is substantially the same except for the configuration of the flange and the pocket iron which iron configuration is dictated by the fact that it is a pocket assembly for a side pocket. The assembly 12 uses the same pocket 20 as the corner pocket assembly 10 and utilizes a support structure 70 for mounting the pocket 20 in the gap between the side rails 16,16. The support structure 70 utilizes a pocket iron 71 which has an outer curved surface and inner curved surface with the curvature of both surfaces being slightly different due to the fact that the gap is between two linearly extending members instead of at the corner. The body portion of the iron 71 is provided with projections 72,72 for mounting the support structure 70 in the gap and to ensure the proper orientation, each of the mounting projections 72 is provided with an aperture for receiving a pin or threaded fastener such as 30.

The support structure 70 includes an integrally molded cover 75 which has an upper surface 76, an outer curved surface 77, an inner curved surface 78 and a bottom surface 79. The curvature of both the inner and outer surfaces 77, 78 is substantially less due to the assembly being a side pocket assembly. An integrally molded flange 80 extends downwardly from the bottom surface and has a curvature substantially the same as the curvature of the outer curved surface 77. As in the previous embodiment, the flange 80 is adjacent to the outer curved surface and spaced inwardly to provide an offset; however, the flange 80 is substantially longer and forms an integral fringe terminating in a configured edge 81. A shield 82 which has center portion 83 and a pair of end portions 84, is also integral with the cover. The center portion 83 extends downward from a curved line adjacent the merger of the bottom surface 79 and the inner curved surface 78 and which line has a curvature substantially the same as the flange 80 to provide a recess 85 for receiving the reinforcing band 56 of the pocket 20. In the corner pocket, the end portions extend substantially parallel to the ends of the cover and are flat with the ends of the rail 16 to provide a good covering of any of the raw edges thereof. Each of the end portions may have an extending tab 90 which may be cut and shaped to merge with the ends of the resilient bumpers 17 to form a smooth throat or entrance for the pocket.

Although various minor modifications may be suggested by those versed in the art, it should be understood that I wish to employ within the scope of the patent warrented herein, all such modifications as reasonably and properly come within the scope of my contribution to the art.

I claim:

1. A pocket assembly for a pool table comprising a pocket and a pocket support structure mountable in a gap between the ends of rails of a pool table to support the pocket beneath the gap and adjacent a cut-out portion of a bed of a table, said support structure including a pocket iron having a body portion with a pair of spaced ends, each end having a mounting projection extending therefrom; and a synthetic cover integrally molded on the body portion with the projections extending therethrough, said cover having an upper surface extending between said pair of ends to provide a surface across the gap, an outer curved surface extending between said pair of ends and extending downward from the upper surface, an inner curved surface slanting downward and outwardly from the upper surface to deflect a ball downward, and a bottom surface interconnecting the inner and outer curved surfaces, said cover including an integral outer curved flange extending downwardly from the bottom surface adjacent the outer surface and having substantially the same curved configuration as the outer surface, and an integral, downwardly extending shield having a center portion and a pair of end portions, said center portion having a curvature approximately the same as the curvature of the flange and extending from a curved line adjacent to a merger between the inner and the bottom surfaces and equally spaced from the flange to provide a curved recess between the center portion and flange for receiving a portion of the pocket, each of said end portions of the shield extending inwardly from the center portion along the end of the cover, said pocket being joined to the cover by having portions inserted into the curved recess and attached to said flange.

2. A pocket assembly according to claim 1, wherein the flange along its length is equally spaced from the outer surface to provide an inset for receiving fringe attached to the outer surface of the flange.

3. A pocket assembly according to claim 1, wherein the center portion of the shield extends downward past the lower edge of the flange.

4. A pocket assembly according to claim 3, wherein each of the end portions of the shield are provided with integral, projecting tabs for forming a smooth joint with the end of the bumpers which form the entrance to the pocket.

5. A pocket assembly according to claim 4, wherein said tabs extend at an angle from the end portion of the shield.

6. A pocket assembly according to claim 1, wherein the pocket is a single container of molded synthetic material having a body portion with a plurality of openings and an opened upper end.

7. A pocket assembly according to claim 6, wherein the opened upper end has a step configuration providing an upper end portion and a lower end portion, said upper end portion terminating in an integral reinforcing band which is inserted in the curved recess, and said lower end portion having spaced, upwardly extending tabs which are adapted for attachment to a bottom surface of the table adjacent the cut-out portion of the bed.

8. A pocket support structure adapted for supporting a pocket on a pool table, said support structure including a pocket iron having a body portion with a pair of ends and with a mounting projection extending from each of said ends and a synthetic cover integrally molded on the body portion with the projection extending therethrough, said cover having an upper surface extending between said pair of ends, an outer curved surface extending between said pair of ends and downward from the upper surface, an inner curved surface slanting downward and outwardly from the inner surface, and a bottom surface interconnecting the inner and outer surfaces, said cover including an integral outer curved flange extending downwardly from the bottom surface adjacent the outer surface and having substantially the same curved configuration as the outer surface and said cover having an integral downwardly extending shield having a center portion and a pair of end portions, said center portion having a curvature approximately the same as the curvature of the flange and extending from a curved line adjacent to the merger between the inner surface and the bottom surface and equally spaced from the flange to provide a curved recess between the center portion and flange for receiving portions of the pocket to be attached thereto, each of said end portions extending inwardly from the center portion along the ends of the cover.

* * * * *